US006590320B1

(12) United States Patent
Abanshin et al.

(10) Patent No.: US 6,590,320 B1
(45) Date of Patent: Jul. 8, 2003

(54) THIN-FILM PLANAR EDGE-EMITTER FIELD EMISSION FLAT PANEL DISPLAY

(75) Inventors: Nikolay Pavlovich Abanshin, Saratov (RU); Boris Isaakovich Gorfinkel, Saratov (RU)

(73) Assignee: Copytale, Inc., Melville, NY (US)

( * ) Notice: Subject to any disclaimer, the term of this patent is extended or adjusted under 35 U.S.C. 154(b) by 0 days.

(21) Appl. No.: 09/511,437

(22) Filed: Feb. 23, 2000

(51) Int. Cl.[7] ..... H01J 1/02

(52) U.S. Cl. ..... 313/309; 313/351; 313/355; 313/306; 313/496

(58) Field of Search ..... 313/346 R, 351, 313/355, 309, 494, 495, 497, 306, 496

(56) References Cited

U.S. PATENT DOCUMENTS

| | | | | | |
|---|---|---|---|---|---|
| 5,202,571 | A | * | 4/1993 | Hirabayashi et al. | 257/10 |
| 5,214,347 | A | | 5/1993 | Gray | 313/355 |
| 5,243,252 | A | * | 9/1993 | Kaneko et al. | 313/309 |
| 5,345,141 | A | | 9/1994 | Moyer et al. | 313/495 |
| 5,652,083 | A | | 7/1997 | Kumar et al. | 430/315 |
| 5,679,043 | A | | 10/1997 | Kumar | 445/24 |
| 5,691,600 | A | | 11/1997 | Moyer et al. | 313/497 |
| 5,763,997 | A | | 6/1998 | Kumar | 313/495 |
| 5,818,166 | A | | 10/1998 | Karpov et al. | 313/495 |
| 5,861,707 | A | | 1/1999 | Kumar | 313/309 |
| 5,871,383 | A | | 2/1999 | Levine et al. | 445/52 |

* cited by examiner

*Primary Examiner*—Sandra O'Shea
*Assistant Examiner*—Guiyoung Lee
(74) *Attorney, Agent, or Firm*—Duane Morris LLP

(57) ABSTRACT

A field-emission-display (FED) having a pixel structure which operates at small anode voltages, and thus, provides the FED with an increased life-time. The pixel structure of the FED includes an edge emitting cathode and an anode spaced from the cathode. The cathode has a first conductive film with a low electron affinity, such as alpha-carbon and a second conductive film disposed on the first conductive film. The first conductive film has an edge which is operative for emitting an electron beam. The anode has a third conductive film and a layer of light emitting material disposed over the third conductive film. Both the cathode and the anode are fabricated on a single glass substrate, which provides simple and reliable mass production technology compatible with planar silicon batch fabrication technology.

34 Claims, 10 Drawing Sheets

THIN-FILM PLANAR EDGE-EMITTER FIELD EMISSION FLAT PANEL DISPLAY

FIELD OF THE INVENTION

This invention relates to flat panel displays (FPD), and in particular, to a flat panel display having an emitter which is formed by edges of thin carbon films

BACKGROUND OF THE INVENTION

Flat panel display manufacturing is one of the fastest growing industries in the world, with a potential to surpass and replace the Cathode Ray Tube industry in the foreseeable future. This will result in a large variety of the FPDs, ranging from very small virtual reality eye tools or displays for cellular phones, to large TV-on-the wall displays, with digital signal processing and high-definition screen resolution.

Some of the more important requirements of FPDs are video rate of the signal processing (moving picture); high resolution typically above 100 DPI (dots per inch); color; high contrast ratios, typically greater than 20; flat panel geometry; high screen brightness, typically above 100 $cd/m^2$; and large viewing angle.

At present, liquid crystal displays (LCD) dominate the FPD market. However, although tremendous technological progress has been made in recent years, LCDs still have some drawbacks and limitations which pose significant restraints on the entire industry. First, LCD technology is rather complex, which results in a high manufacturing cost and price of the product. Other deficiencies, such as small viewing angle, low brightness and relatively narrow temperature range of operation, make application of the LCDs difficult in many high market value areas, such as car navigation devices, car computers, and mini-displays for cellular phones.

Other FPD technologies capable of competing with the LCDs, are currently under intense investigation. Among these technologies, plasma displays and field-emission displays (FED) are considered the most promising. Plasma displays employ a plasma discharge in each pixel to produce light. One limitation associated with plasma displays is that the pixel cells for plasma discharge cannot be made very small without affecting neighboring pixel cells. This is why the resolution in a plasma FPD is poor for small format displays but becomes efficient as the display size increases above 30" diagonal. Another limitation associated with plasma displays is that they tend to be thick. A typical plasma display has a thickness of about 4 inches.

FEDs employ "cold cathodes" which produce mini-electron beams that activate phosphor layers in the pixel. It has been predicted that FEDs will replace LCDs in the future. Currently, many companies are involved in FED development. However, after ten years effort, FEDs are not yet in the market.

FED mass production has been delayed for several reasons. One of these reasons concerns the fabrication the electron emitters. The traditional emitter fabrication is based on forming multiple metal (Molybdenum) tips, see C. A. Spindt "Thin-film Field Emission Cathode", Journ. Of Appl. Phys, v. 39, 3504, and U.S. Pat. No. 3,755,704 issue to C. A. Spindt. The metal tips concentrate an electric field, activating a field induced auto-electron emission to a positively biased anode. The anode contains light emitting phosphors to produce an image. The technology for fabricating the metal tips, together with controlling gates, is rather complex. In particular, fabrication requires a sub-micron, e-beam, lithography and angled metal deposition in a large base e-beam evaporator, which is not designed for high throughput production.

Another difficulty associated with FED mass production relates to life time of FEDs. The electron strike of the phosphors results in phosphor molecule dissociation and formation in a vacuum chamber of gases, such as sulfur oxide and oxygen. The gas molecules reaching the tips screen the electric field, reducing the efficiency of electron emission from the tips. Another group of gases, produced by electron bombardment, contaminates the phosphor surface and forms undesirable energy band bending at the phosphor surface. This prevents electron-hole diffusion from the surface into the depth of the phosphor grain, reducing the light radiation component of electron-hole recombination from the phosphor. These gas formation processes are interrelated and directly connected with vacuum degradation in the display chamber.

The gas formation processes are most active in the intermediate anode voltage range of 200–1000V. If, however, the voltage is elevated to 6–10 kV, the incoming electrons penetrate deeply into the phosphor grain. In this case, the products of phosphor dissociation are sealed inside the grain and cannot escape into the vacuum. This result significantly increases the life time of the FED and makes it close to that of a conventional cathode ray tube.

The high anode voltage approach is currently accepted by all FED developers. This, however, creates another problem. To apply such a high voltage, the anode must be made on a separate substrate and removed from the emitter a significant distance equaling about 1 mm. Under these conditions, the gate controlling efficiency decreases, and pixel cross-talk becomes a noticeable factor. To prevent this effect, an additional electron beam focusing grid is introduced between the first grid and the anode, see e.g. C. J. Spindt, et al. "Thin CRT Flat-Panel-Display Construction and Operating Characteristics", SID-98 Digest, p. 99, which further complicates display fabrication.

FIG. 1 illustrates a conventional tip-based pixel FED 10 with an additional electron beam focusing grid 11. The FED 10 includes an anode 16 and a cathode 12 having a plurality of metal tip-like emitters 13, a gate 14 made as a film with small holes 15 above the tips of the emitters 13. The emitters 13 produce mini-electron beams 19 that activate phosphors 17 contained by the anode 16. The phosphors 17 are coated with a thin film of aluminum 18. The metal tip-like emitters 13 and holes 15 in the controlling gate 14, which are less than 1 $\mu$m in diameter, are expensive and time consuming to manufacture, hence they are not readily suited for mass production.

Another approach to FED emitter fabrication involves forming the emitter in the shape of a sharp edge to concentrate the electric field. See U.S. Pat. No. 5,214,347 entitled "Layered Thin-Edge Field Emitter Device" issued to H. F. Gray. The emitter described in this patent is a three-terminal device for operation at 200V and above. The emitter employs a metal film the edge of which operates as an emitter. The anode electrode is fabricated on the same substrate, and is oriented normally to the substrate plane, making it unsuitable for display functions. A remote anode electrode is provided parallel to the substrate, making it suitable for the display purposes. The anode electrode, however, requires a second plate which significantly complicates the fabrication of the display.

Still another approach to FED emitter fabrication can be found in U.S. Pat. No. 5,345,141, entitled "Single Substrate Vacuum Fluorescent Display", issued to C. D. Moyer et al. which relates to the edge-emitting FED. This patent discloses two pixel structures that use a diamond film as an edge emitter.

FIGS. 2A and 2B show the two pixel structures similar to those described in U.S. Pat. No. 5,345,141. A diamond film denoted by numerals 20 and 25 in the respective figures, is deposited on top of a metal film 21, 26. Since the diamond is an ideal insulator and the only diamond edge exposed is the very top one, as indicated by an arrow "O" in FIG. 2B, only a relatively small fringing electric field coming from the metal film 26 underneath the diamond film 25, contributes to the field emission process from this edge.

Another limitation of the emitter depicted in FIG. 2A is that the emitter films, including the diamond film 20 and the insulator film 23, are grown on a phosphor film 24, which is known to have a very rough surface morphology that makes its practically unsuitable for any further film deposition on top of it. A further limitation of the pixel structure depicted in FIG. 2B, relates to its probable poor emission efficiency which is due to the phosphor layers 27 on the both sides of the emitter. At the anode side, the electric field is concentrated at the phosphor film edge, such that the electrons reaching the phosphor will strike mostly this edge resulting in phosphor activation only on the side of the phosphor pad.

Accordingly, there is a need for a new FED pixel design which substantially eliminates the problems associated with prior FEDs, and which allows for mass production.

SUMMARY OF THE INVENTION

A field-emission-display (FED) having a pixel structure which operates at small anode voltages, and thus, provides the FED with an increased life-time. The pixel structure of the FED comprises an edge emitting cathode and an anode spaced from the cathode. The cathode includes a first conductive film with a low electron affinity, such as alpha-carbon and a second conductive film disposed on the first conductive film. The first conductive film has an edge which is operative for emitting an electron beam. The anode includes a third conductive film and a layer of light emitting material disposed over the third conductive film.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not to scale.

DETAILED DESCRIPTION OF THE INVENTION

The FED to be described below includes a new pixel structure which is designed for operation at small anode voltages. Reduction of the anode bias down to 50–70V decreases the rate of phosphor molecule dissociation by more than an order of magnitude in comparison with the high voltage rates and thus increases the display life time.

Figure 1:
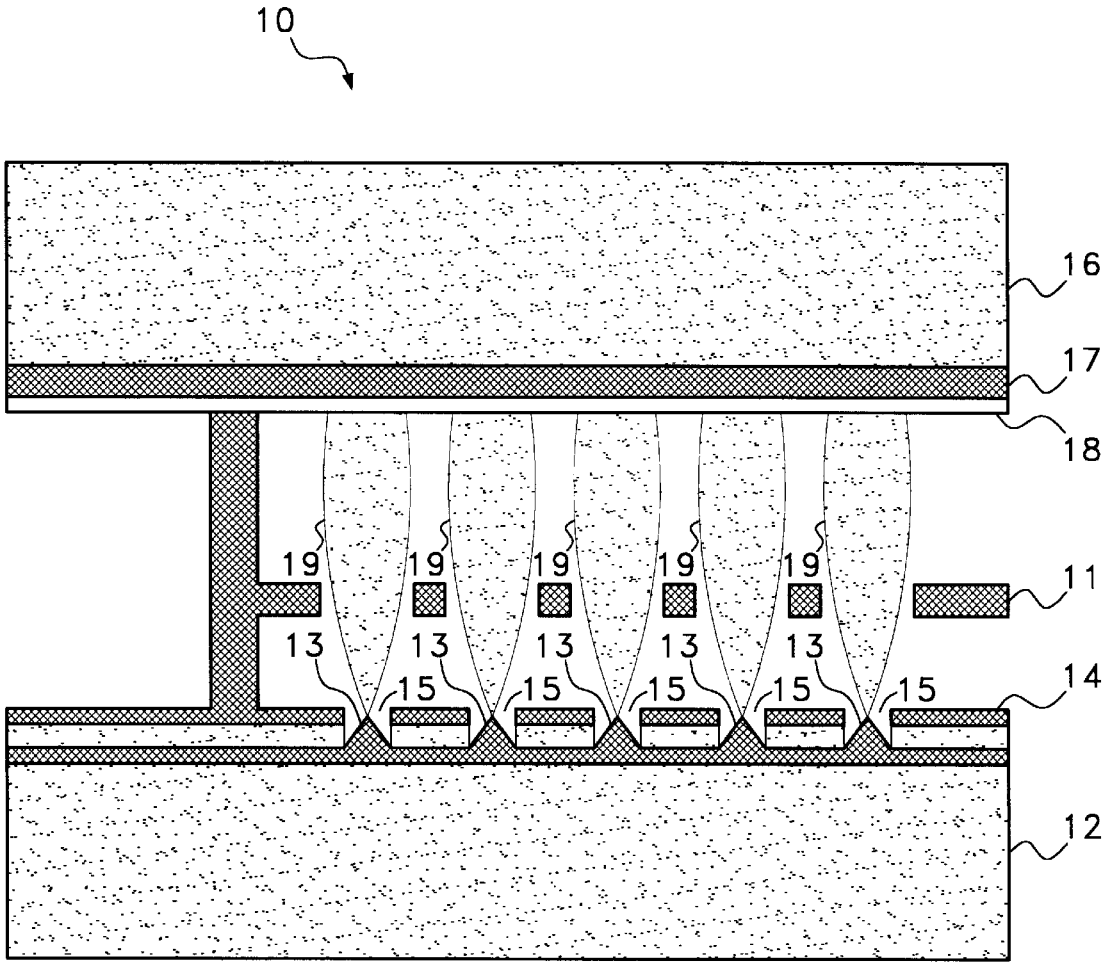
Fig. 1 (Prior Art)
FIG. 1 is sectional view of a conventional tip-based pixel FED with an additional electron beam focusing grid.
Figure 2A:
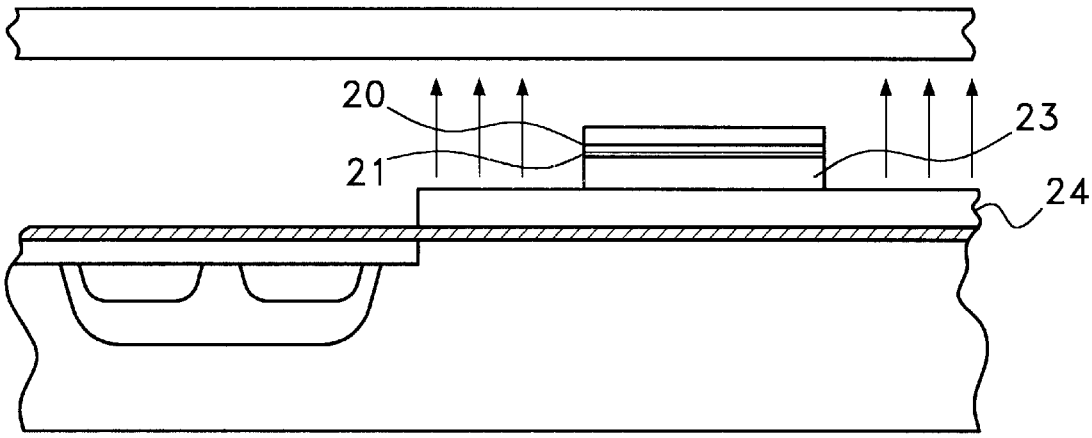
FIGS. 2A and 2B show two previously proposed pixel structures.
Figure 2B:
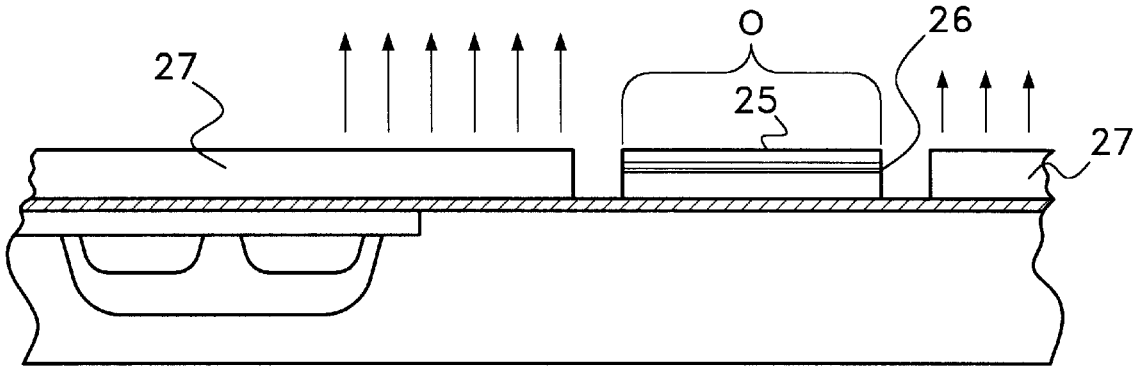
Figure 3A:
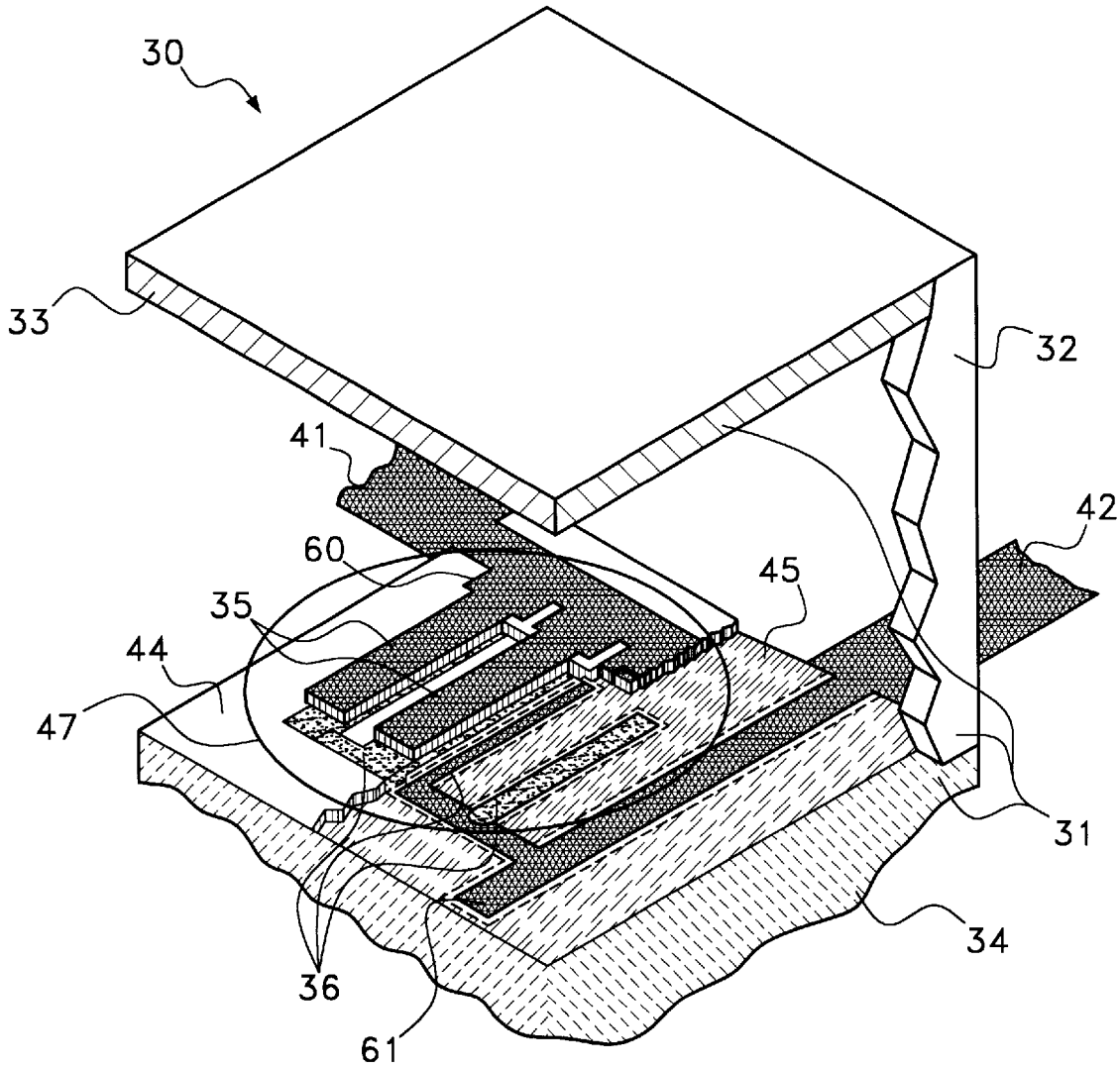
FIG. 3A is a perspective cut-away view of an FED employing a diode pixel structure according to an embodiment of the invention.
Figure 3B:
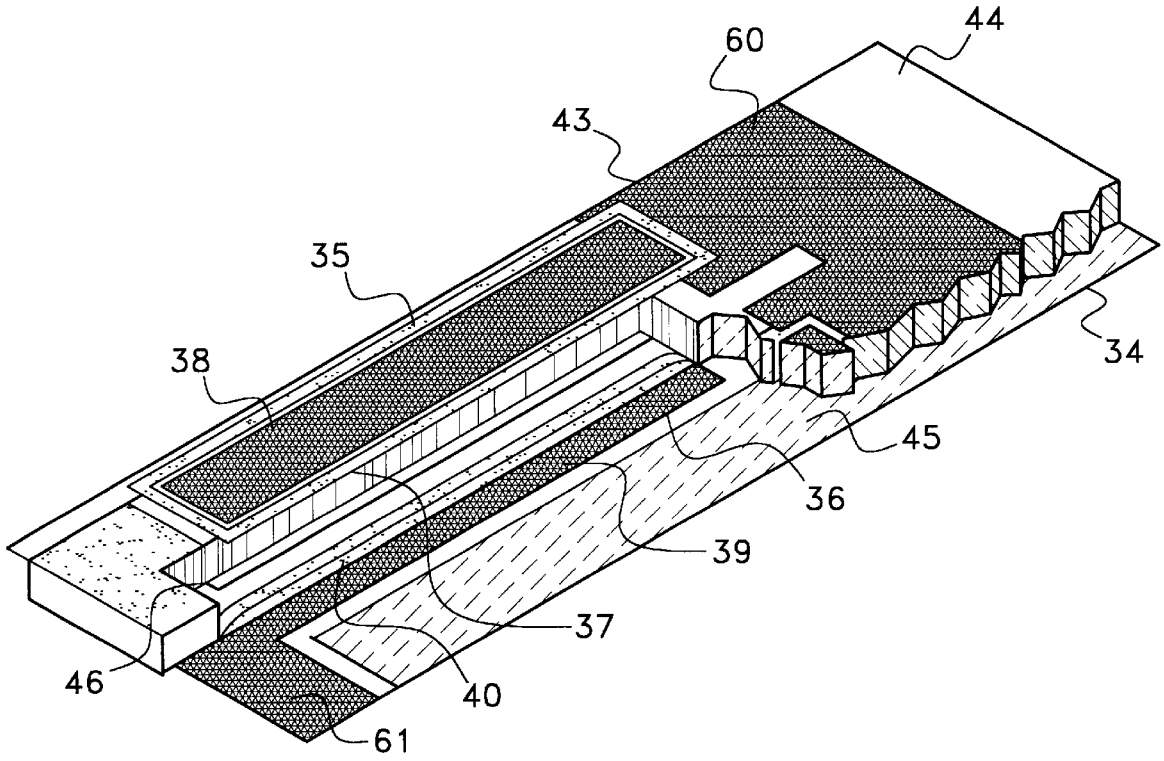
FIG. 3B is an enlarged view of the pixel structure shown in FIG. 3A.

FIGS. 3A and 3B collectively show a field-emission display 30 (FED) employing a diode pixel structure made according to an embodiment of the invention. As shown in FIG. 3A, the FED 30 includes a vacuum enclosure 31 formed by a dielectric perimeter frame 32 hermetically closed on a front side by a flat, transparent glass face plate 33, and closed on a rear side by a glass substrate 34 which defines a diode pixel structure 47 formed by a serpentine-shaped cathode 35 and a serpentine-shaped anode 36.

As best seen in FIG. 3B, the cathode 35 is formed by a conductive emitter film 37 having a low electron affinity, covered by a conductive film 38 of aluminum, ITO or any other suitable conductive material. The anode 36 is formed by a conductive film 39 of aluminum, ITO or any other suitable conductive material, covered by a layer 40 of phosphor or any other suitable light emitting material. When phosphor is used as the light emitting material, it very important to use reliable and efficient, sulfur oxide-free, low voltage phosphors. These phosphors are used in vacuum fluorescent displays which typically operate in the voltage range 50–70 V and have a long life time. The preferred phosphors are: $(ZnCd)_x$ SAg for emission of red light; ZnO:Zn for emission of green light; and ZnSAgCl for emission of blue light.

The cathode 35 and anode 36 are connected through cathode and anode lines 60, 61 to leads 41, 42 which permit the connection of voltage sources (FIG. 3A). The cathode 35 and anode 36 are arranged with a small controlled space between each other in upper and lower parallel planes 44, 45 of the substrate 34. The cathode 35 is located in the upper plane 44 of the substrate 34, and the anode 36 is located in the lower plane 45 of the substrate 34. A plurality of elongated windows 46 are formed in the substrate 34. Tines 51 (FIG. 5) of the anode 36 are located at the bottom of the windows 46.

Figure 4:
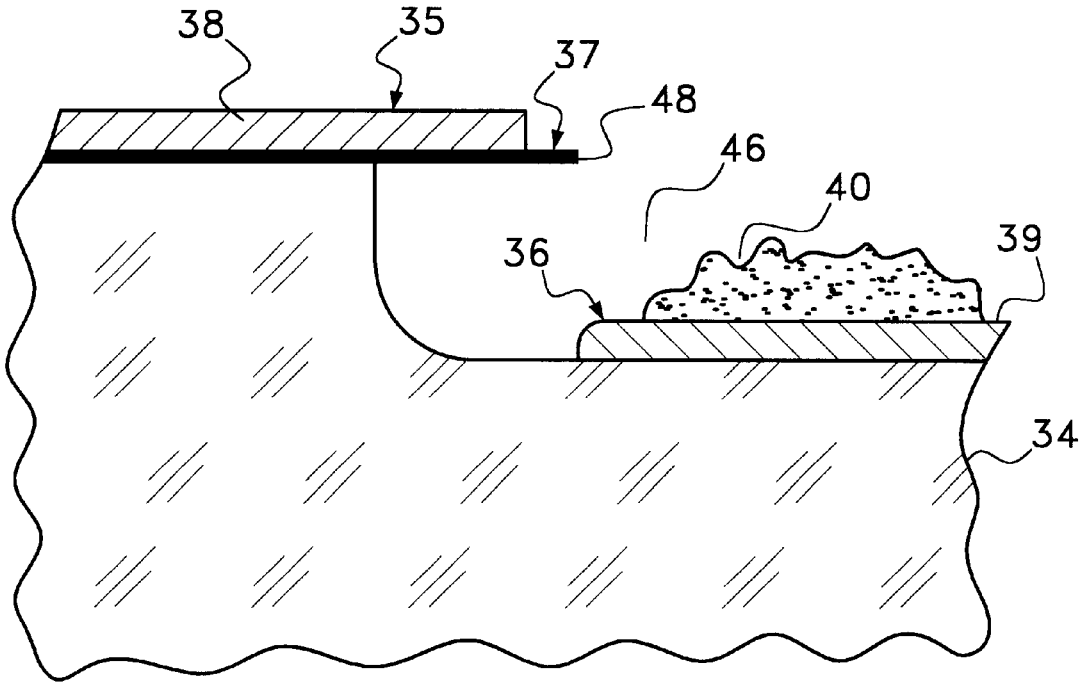
FIG. 4 is a sectional view of the diode pixel structure.

Referring to FIG. 4, the conductive emitter film 37 deposited on the upper plane 44 of the substrate 34, is about 20–40 nanometers in thickness. Each tine 50 (FIG. 5) of the cathode 35 extends partially over its associated window 46, with a sharp edge 48 of the conductive emitter film 37 projecting out from underneath the conductive cathode film 38. It is this edge 48 of the conductive emitter film 37 that concentrates the electric field on the phosphor layer 40 the anode 36.

One of the benefits of this construction is the absence of cathode-to-anode overlap. The spatial separation of the cathode 35 and anode 36 reduces pixel capacitance, thus, increasing the frequency range of operation of the proposed FED.

As mentioned previously, it is important that the conductive emitter film 37 of the cathode 35 exhibit a low electron affinity. Accordingly, in a preferred embodiment of the invention, the conductive emitter film 37 is composed of an alpha-carbon material (α-C). The electron field emission is an exponential function of the electron affinity, see e.g. R. H. Fowler and L. Nordheim "Electron Emission in Intense Electric Field", Proc. Poy. Soc. 119, 173, 1928, and is calculated to yield (at the same electric field strength) the emission current from the α-C film several order of magnitudes higher than that from conventional Mo films. Further, unlike diamond films, carbon films are conductive. Hence, an electric field can be concentrated at the edge 48 of a carbon emitter film 37. The conductive cathode film 38 on top of the carbon emitter film 37, serves to reduce total resistance of the cathode 35.

Another advantage of the preferred carbon emitter film 37 is that it is simple and reliable to manufacture, entirely compatible with standard silicon planar batch fabrication technology. This is because both the cathode 35 and anode 36 are made on a single glass substrate 34. Conventional sequential layer depositions, wet etching and simple photolithography are typically used for fabricating the carbon emitter film 37. The natural electrical insulating properties of the glass (instead of deposition of additional insulating layers which are subject to strong cathode-anode electric fields) are used to provide excellent anode-to-cathode insulation. Self-aligned methods are used to deposit the tines 51 of the anode 36 into the windows 46, hence, further simplifying device processing. Additionally, the edge 48 of the carbon emitter film 37 as a distributed source of electrons, is expected to be more resistive to the gas induced cathode degradation in comparison with conventional metal tip emitters, as the total edge area per pixel is about two orders of magnitude larger than the tip area of all the tips in a conventional FED (typically 4,000 tips per pixel in conventional FEDs).

Figure 5:
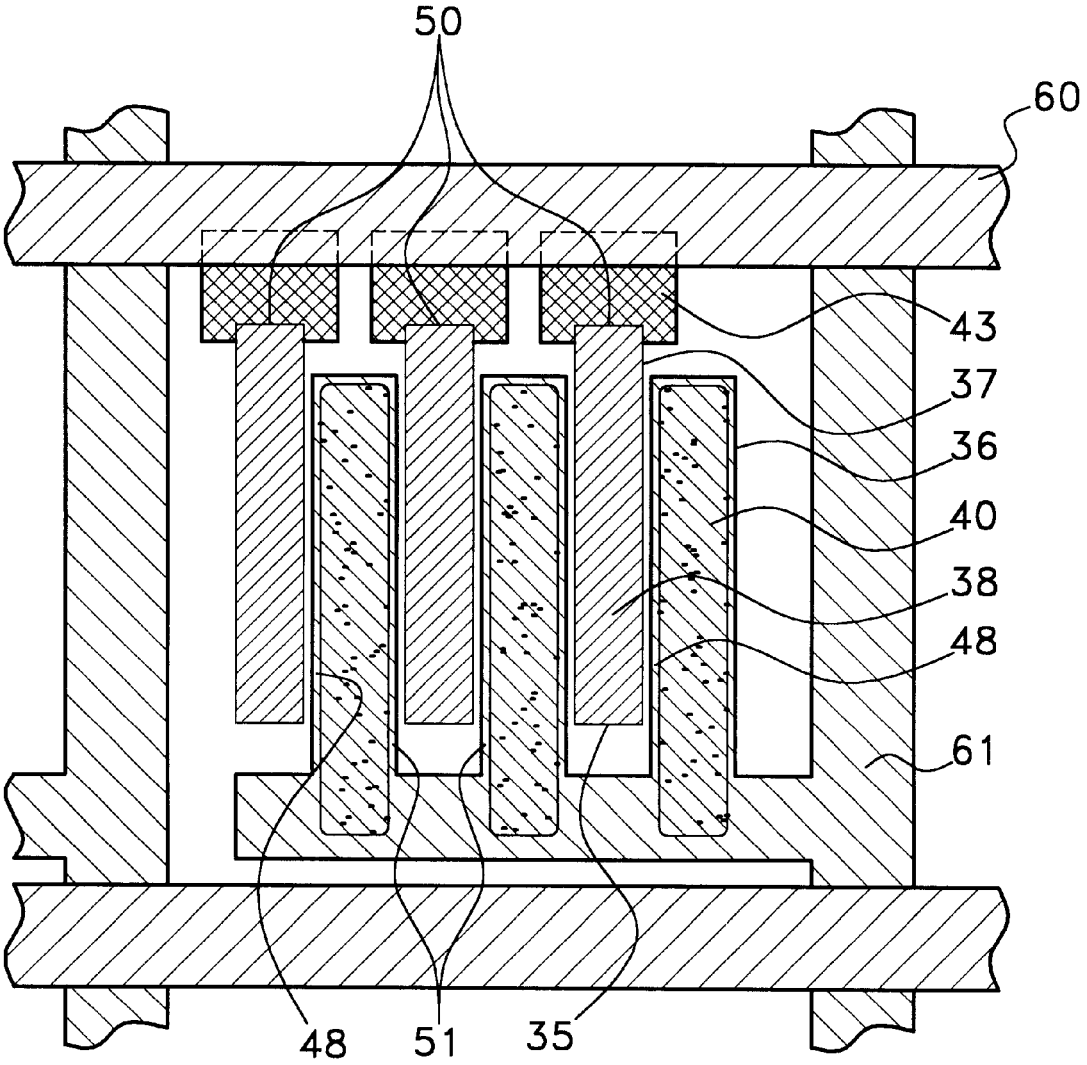
FIG. 5 is a plan view of the diode pixel structure.

The serpentine shape of both the cathode 35 and anode 36 with their tines 50, 51 interdigitated, is best shown in FIG. 5. Such a cathode geometry increases the length of the carbon emitter film's 37 edge 48, and therefore, the emission current at fixed voltage. The resultant edge length can be made as long as a few mm per pixel. To ensure uniform emission current distribution along the entire edge, a resistor film 43 is deposited on the tines 50 of the cathode 35 and connected in series with cathode-anode pixel circuit. High series resistance limits the pixel current thereby providing current uniformity.

Figure 6:
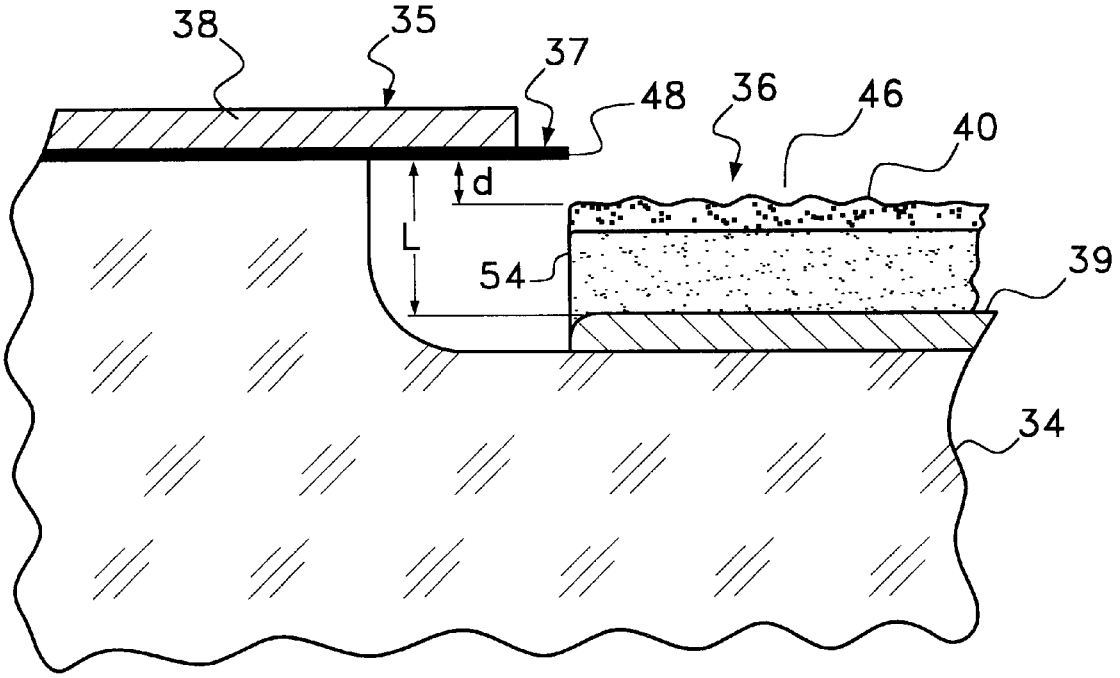
FIG. 6 is a sectional view of a diode pixel structure according to a second embodiment of the invention.

FIG. 6 shows a second embodiment of the pixel structure. In this embodiment, the phosphor layer 40 is placed on a pedestal layer 54 of metal material, such as aluminum, which is grown or otherwise deposited on the conductive anode film 39 in the substrate window 46. This modification brings the phosphor layer 38 closer to the cathode 35, thus, decreasing the distance between the cathode 35 and the anode 36. More specifically, the original distance L between the plane of the anode 36 and the plane of the cathode 35 is made relatively large, about 10 μm, (typically this distance is about 2–4.5 μm in the previous embodiment without the pedestal) while the actual cathode-to-anode spacing d is controlled by the height of the pedestal layer 54. In practice, this distance d can be made smaller than 1 μm, hence, increasing the input capacitance by a factor of ten over that of the FED of the previous embodiment. This factor increases the frequency range of operation for the display driving circuits (not shown). To provide a controllable and small cathode-to-anode distance, sub-micron grain phosphors are used.

The important advantage of the proposed low-voltage FED is its diode pixel configuration, as compared with high-voltage, metal tip-based FEDs, which require a three-terminal design. The diode pixel structure of the invention, where both the cathode 35 and the anode 36 are made on the same substrate 34, ensures the absence of cross-talk between pixels. This is due to the cathode-to-anode electric field being entirely confined within the pixel cell, and the anodes of the different pixels being completely isolated from each other. This advantageously provides the FED of the invention with a high resolution, with achievable monochrome resolution as high as 250 DPI and above.

Complete confinement of the active pixel cells to the substrate offers another important advantage of the FED of the invention. In particular, it is easy to fabricate glass spacers or pillars (not shown) between the pixel structure and the sealing glass (not shown) within the same process to minimize the glass thickness needed to withstand the atmospheric pressure. This allows fabrication of a very thin display at any display area.

Figure 7:
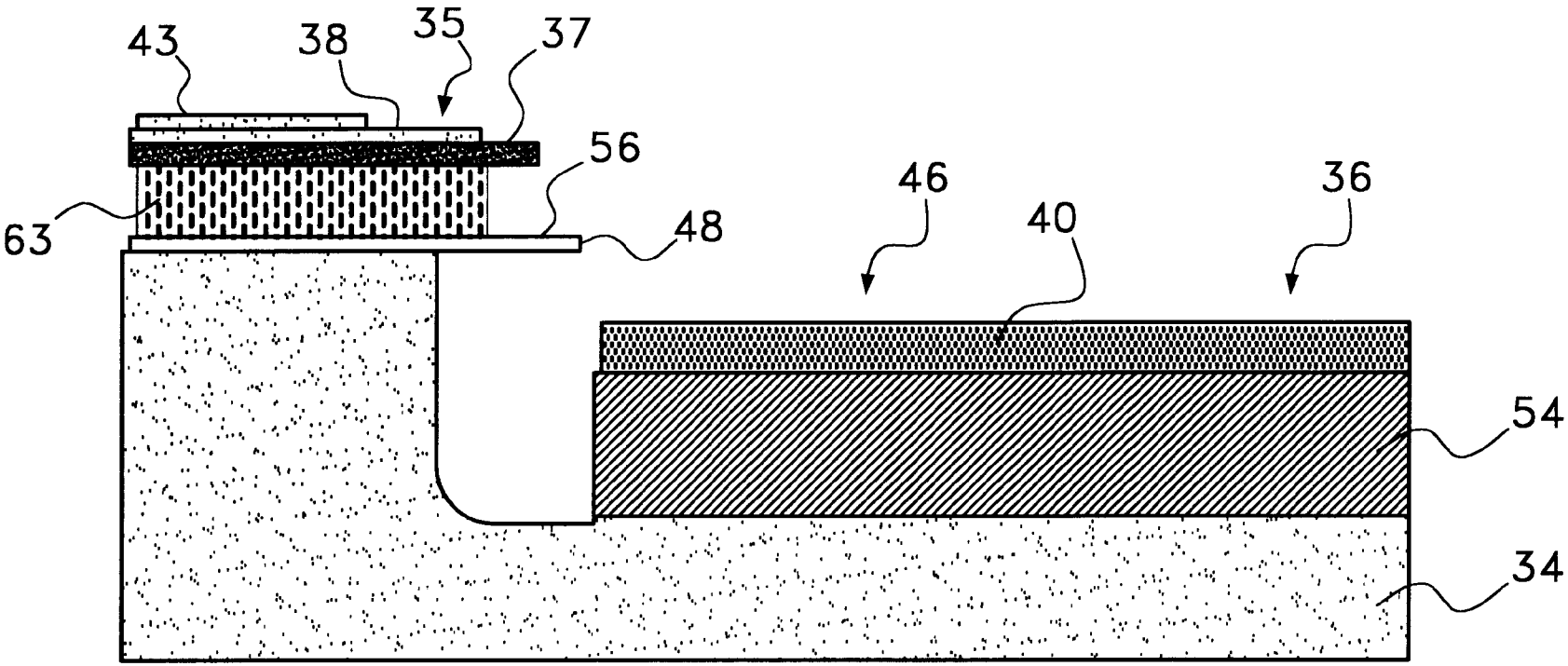
FIG. 7 is a sectional view of a triode pixel structure according to a third embodiment of the invention.

It is easy to extend the inventive pixel design described herein to a three-terminal configuration if desired, as shown in FIG. 7. This is accomplished by providing a conductive grid film 56 (control gate) between the cathode 35 and the anode 36. The grid film 56 is electrically insulated from the cathode 35 by an insulative film 63, such as silicon dioxide ($SiO_2$). As in the previous design, all pixel activities, as well as the display processing, occur on one substrate (substrate 34), and the electric field is confined within the pixel 47 with no cross-talk expected.

The FED of the invention can be manufactured according to the following sequence of operations. Grooves are wet etched into a surface of the substrate and the bottoms of the grooves are coated with a film of conductive material to form anode lines of the anode. The surface of the substrate is then coated with an insulative material, such as a low temperature melting glass or polyamide to planarize surface. The entire surface is coated with a resistive layer, after which the topology of the protection resistors is formed by photolithography. The entire surface is coated with conductive alpha-carbon emitting film using plasma-chemical deposition or like methods followed by evaporation of the a film of conductive material. Photolithography is performed to define the cathode in the conductive cathode films and to etch elongated windows in the glass coating of the substrate. The windows are etched down to the underlying original substrate surface. A film of conductive material (aluminum, ITO, or the like) is deposited in each of the windows using a self-aligned, e-beam evaporation or like method. The conductive films in the windows contact the anode lines. The optional pedestals are fabricated at this time on the conductive anode films in the windows using conventional metal electroplating methods. A layer of the low voltage fine grain phosphor is deposited on the conductive anode films (or the pedestals) in each of the windows using catophoretic deposition or like methods, thus, completing the anode. The substrate and faceplate are then mounted and hermetically sealed to dielectric perimeter frame to form the vacuum enclosure.

EXPERIMENTAL RESULTS

Figure 8:
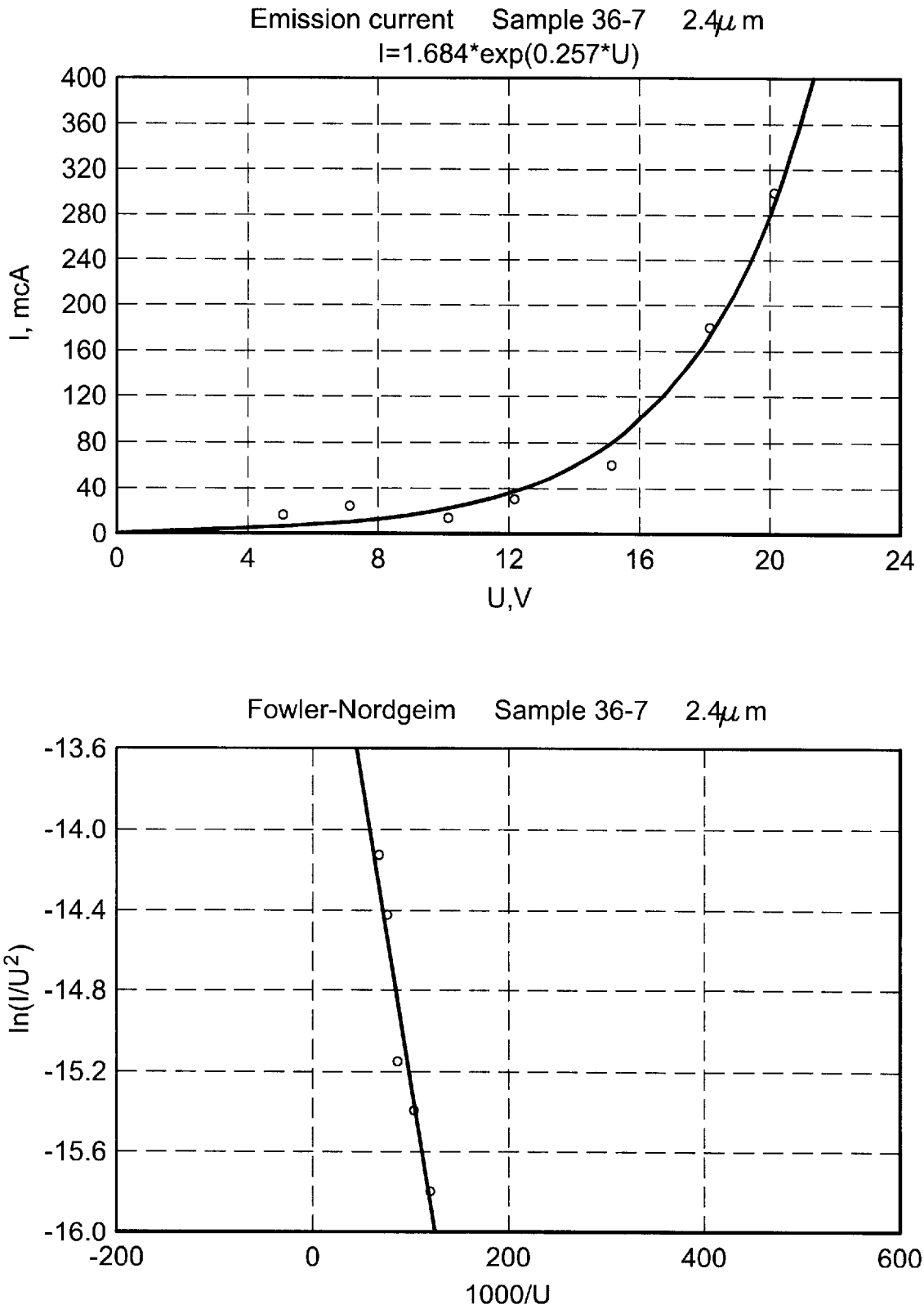
FIGS. 8 and 9 illustrate the current-voltage characteristics in a linear and a specific logarithm scale to prove a Fowler-Norgeim (field emission) character of the current.
Figure 9:
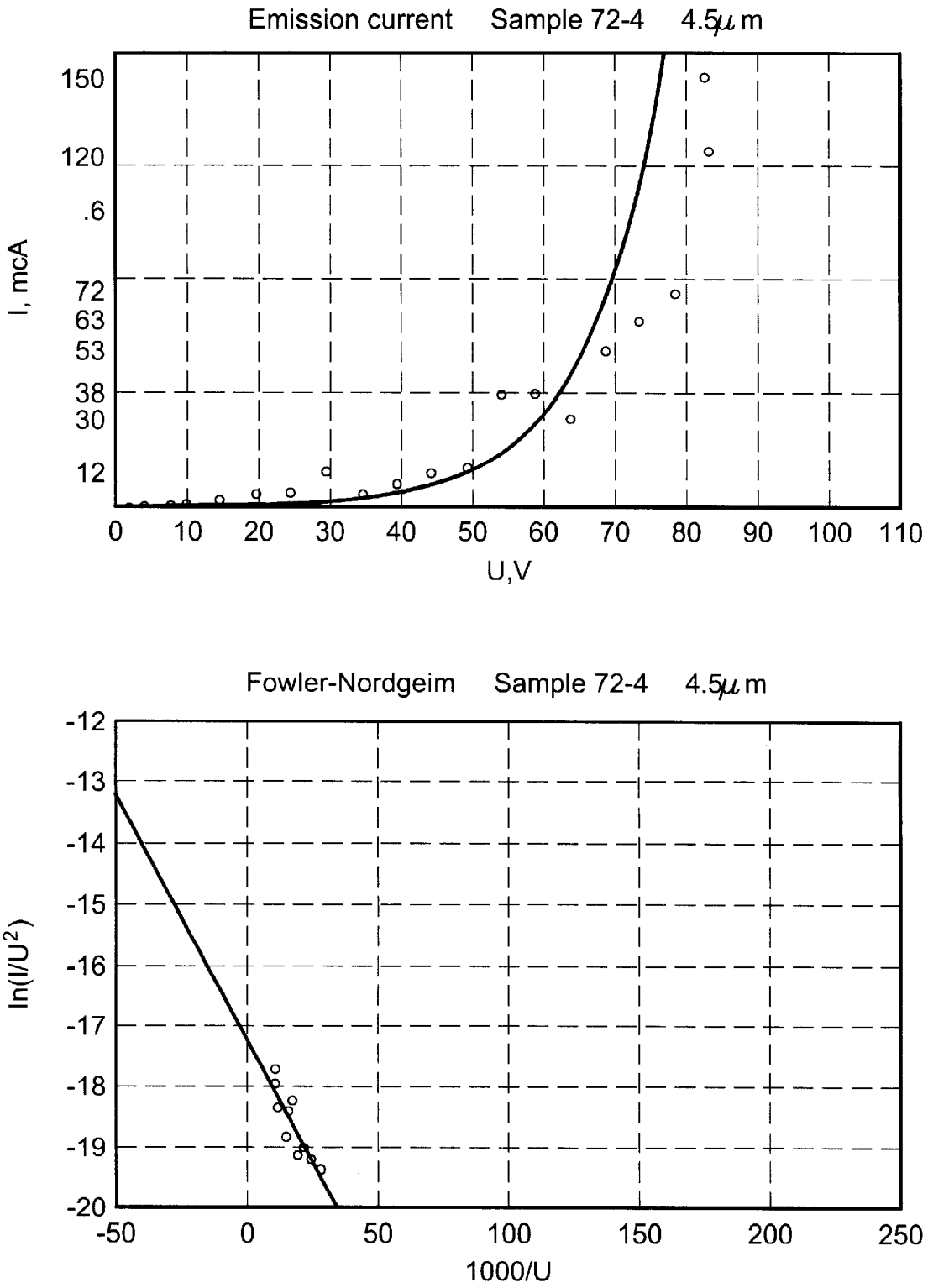

The measurement of the field emission from a carbon film edge emitter were carried out on a diode pixel structure without the pedestal. FIGS. 8 and 9 illustrate the current-voltage characteristics in a linear and a specific logarithm scale to prove a Fowler-Norgeim (field emission) character of the current. The structures tested did not contain the pedestal and the anode and-cathode distance (without taking into account the phosphor thickness) was 2.4 μm in FIG. 8 and 4.5 μm in FIG. 9. An exponential, field emission nature of the current is evident in both plots, with significant reduction of the voltage at the given current for shorter anode-to-cathode distances. These experiments imply that the voltages as small as 20–50 V are sufficient to drive the display.

While the foregoing invention has been described with reference to the above embodiment, various modifications and changes can be made without departing from the spirit of the invention. Accordingly, all such modifications and changes are considered to be within the scope of the appended claims.

What is claimed is:

1. An edge-film electron emitter for a field-emission display, the emitter comprising:

a first alpha-carbon conductive film having a low electron affinity; and a second conductive film disposed on the first conductive film, the second conductive film enhancing the conductivity of the first conductive film, the first and second conductive films functioning as a cathode when used in a field-emission display, the first conductive film having an edge which is operative for emitting an electron beam.

2. The emitter according to claim 1, wherein the second conductive film is made from a metal material.

3. The emitter according to claim 1, further comprising a resistive film in contact with one of the first and second conductive films to provide emission current uniformity.

4. The emitter according to claim 1, wherein the films are formed in a geometric shape that maximizes the length of the emitting edge of the first conductive film.

5. A pixel structure suitable for low voltage operation in a field-emission-display, the pixel structure having substantially no cross-talk, the pixel structure comprising:

a cathode having a first conductive film having a low electron affinity and a second conductive film disposed on the first conductive film, the second conductive film enhancing the conductivity of the first conductive film, the first conductive film having an edge which is operative for emitting an electron beam; and an anode spaced from said cathode, the anode having a third conductive film and a layer of light emitting material disposed over the third conductive film, the layer of light emitting material emitting light when activated by an electron beam generated by the edge of the first conductive film of the cathode, said anode further includes a layer of conductive material disposed between the third conductive film and the layer of light emitting material, the layer of conductive material reducing the spacing between the layer of light emitting material and the cathode, the reduced spacing decreasing the anode voltage requirements.

6. The pixel structure according to claim 5, further comprising a substrate of electrically insulative material, the cathode and the anode both disposed on the substrate.

7. The pixel structure according to claim 6, wherein the substrate is made from a glass material.

8. The pixel structure according to claim 6, wherein the substrate includes first and second parallel planes, the cathode disposed on the first plane and the anode disposed on the second plane, the cathode and anode disposed without overlapping one another and the distance between the first and third conductive films being at least 2–4 microns.

9. The pixel structure according to claim 5, wherein the cathode and the anode form a diode pixel structure.

10. The pixel structure according to claim 5, further comprising a conductive grid film disposed between the cathode and the anode, thereby forming a triode pixel structure.

11. The pixel structure according to claim 10, wherein the anode further includes a layer of conductive material disposed between the third conductive film and the layer of light emitting material, the layer of conductive material positioning the layer of light emitting material closer to the cathode.

12. The pixel structure according to claim 5, wherein the first conductive film is made from a carbon material.

13. The pixel structure according to claim 12, wherein the carbon material comprises alpha-carbon.

14. The pixel structure according to claim 5, wherein the second and third conductive films are each made from a metal material.

15. The pixel structure according to claim 5, further comprising a resistive film disposed on the second conductive film to limit the current and thus provide emission current uniformity.

16. The pixel structure according to claim 5, wherein the cathode is formed in a geometric shape that maximizes the length of the emitting edge of the first conductive film.

17. The pixel structure according to claim 5, wherein the layer of light emitting material comprises a sulfur oxide-free phosphor.

18. A field-emission-display comprising:

a cathode having a first conductive film having a low electron affinity and a second conductive film disposed on the first conductive film, the second conductive film enhancing the conductivity of the first conductive film, the first conductive film having an edge which is operative for emitting an electron beam; and an anode spaced from said cathode, the anode having a third conductive film and a layer of light emitting material disposed over the third conductive film, the layer of light emitting material emitting light when activated by an electron beam generated by the edge of the first conductive film of the cathode, said anode further includes a layer of conductive material disposed between the third conductive film and the layer of light emitting material, the layer of conductive material positioning the layer of light emitting material closer to the cathode;

the cathode and anode forming an active pixel structure.

19. The display according to claim 18, further comprising a substrate of electrically insulative material, the cathode and the anode both disposed on the substrate.

20. The display according to claim 19, wherein the substrate is made from a glass material.

21. The display according to claim 19, wherein the substrate includes first and second parallel planes, the cathode disposed on the first plane and the anode disposed on the second plane, the cathode and anode disposed without overlapping one another and the distance between the first and third conductive films being at least 2–4 microns.

22. The display according to claim 18, wherein the cathode and the anode form a diode pixel structure.

23. The display according to claim 18, further comprising a conductive grid film disposed between the cathode and the anode, thereby forming a triode pixel structure.

24. The display according to claim 18, wherein the anode further includes a layer of conductive material disposed between the third conductive film and the layer of light emitting material, the layer of conductive material reducing the spacing between the layer of light emitting material and the cathode, the reduced spacing decreasing the anode voltage requirements.

25. The display according to claim 18, wherein the first conductive film is made from a carbon material.

26. The display according to claim 25, wherein the carbon material comprises alpha-carbon.

27. The display according to claim 18, wherein the second and third conductive films are each made from a metal material.

28. The display according to claim 18, further comprising a resistive film disposed on the second conductive film to provide emission current uniformity.

29. The display according to claim 18, wherein the cathode is formed in a geometric shape that maximizes the length of the emitting edge of the first conductive film.

30. The display according to claim 18, wherein the layer of light emitting material comprises a sulfur oxide-free phosphor.

31. A pixel structure suitable for low voltage operation in a field-emission-display, the pixel structure having substantially no cross-talk, the pixel structure comprising:

a cathode having a first conductive film having a low electron affinity and a second conductive film disposed on the first conductive film, the second conductive film enhancing the conductivity of the first conductive film, the first conductive film having an edge which is operative for emitting an electron beam; and an anode spaced from said cathode, the anode having a third conductive film and a layer of light emitting material disposed over the third conductive film, the layer of light emitting material emitting light when activated by an electron beam generated by the edge of the first conductive film of the cathode;

a substrate of electrically insulative material, wherein the substrate includes first and second parallel planes, the cathode disposed on the first plane and the anode disposed on the second plane, the cathode and anode disposed without overlapping one another and the distance between the first and third conductive films being at least 2–4 microns.

32. The pixel structure according to claim 31, wherein the first conductive film comprises an alpha-carbon.

33. The pixel structure according to claim 31, further comprising a resistive film disposed on the second conductive film to limit the current and thus provide emission current uniformity.

34. The pixel structure according to claim 31, wherein the cathode is formed in a geometric shape that maximizes the length of the emitting edge of the first conductive film.

* * * * *

UNITED STATES PATENT AND TRADEMARK OFFICE

CERTIFICATE OF CORRECTION

PATENT NO. : 6,590,320 B1
DATED : July 8, 2003
INVENTOR(S) : Abanshin et al.

It is certified that error appears in the above-identified patent and that said Letters Patent is hereby corrected as shown below:

Title page,
Item [73], Assignee, should read:
-- Copytele, Inc., Melville, NY (US) --.

Signed and Sealed this

Second Day of December, 2003

JAMES E. ROGAN
*Director of the United States Patent and Trademark Office*